US007964125B2

(12) United States Patent
Olsen

(10) Patent No.: US 7,964,125 B2
(45) Date of Patent: Jun. 21, 2011

(54) MATTE FINISH CARRIER

(75) Inventor: Robert Olsen, Medinah, IL (US)

(73) Assignee: Illinois Tool Works Inc., Glenview, IL (US)

( * ) Notice: Subject to any disclaimer, the term of this patent is extended or adjusted under 35 U.S.C. 154(b) by 201 days.

(21) Appl. No.: 11/881,596

(22) Filed: Jul. 27, 2007

(65) Prior Publication Data

US 2008/0053846 A1 Mar. 6, 2008

Related U.S. Application Data

(60) Provisional application No. 60/840,768, filed on Aug. 29, 2006.

(51) Int. Cl.

| | |
|---|---|
| ***B28B 11/18*** | (2006.01) |
| ***B29C 39/14*** | (2006.01) |
| ***B29C 41/24*** | (2006.01) |
| ***B29C 43/22*** | (2006.01) |
| ***B29C 45/14*** | (2006.01) |
| ***B29D 7/00*** | (2006.01) |
| ***D01D 5/22*** | (2006.01) |
| ***B65D 75/00*** | (2006.01) |

(52) U.S. Cl. ..... 264/165; 264/168; 264/242; 206/139; 206/150

(58) Field of Classification Search ..... 264/47, 264/99, 165, 168, 242; 206/139, 150
See application file for complete search history.

(56) References Cited

U.S. PATENT DOCUMENTS

| | | | | |
|---|---|---|---|---|
| 3,384,696 | A * | 5/1968 | Makansi | 264/321 |
| 4,401,211 | A * | 8/1983 | Pillman et al. | 206/150 |
| 4,574,949 | A * | 3/1986 | Rhoads | 206/150 |
| 5,544,749 | A * | 8/1996 | Watts | 206/459.5 |
| 5,695,050 | A | 12/1997 | Weaver | |
| 2002/0011423 | A1 | 1/2002 | Weaver | |
| 2004/0157042 | A1 * | 8/2004 | Ackerman et al. | 428/141 |

FOREIGN PATENT DOCUMENTS

EP 0 812 780 12/1997

* cited by examiner

*Primary Examiner* — Khanh Nguyen
*Assistant Examiner* — Matthew Hoover
(74) *Attorney, Agent, or Firm* — Pauley Petersen & Erickson

(57) ABSTRACT

A carrier and method of manufacture for a carrier that results in a package of containers includes a plastic sheet having an array of container apertures and a portion having a matte finish where the matte finish includes a lower coefficient of friction relative to a container than a remaining surface of the plastic sheet. A plurality of containers are each positioned within an aperture of the array so that the matte finish of the plastic sheet is positioned along an inner portion of the package and the remaining surface of the plastic sheet is positioned along an outer portion of the package.

6 Claims, 3 Drawing Sheets

MATTE FINISH CARRIER

CROSS REFERENCE TO RELATED APPLICATION

This application claims the benefit of U.S. Provisional Application No. 60/840,768 filed on 29 Aug. 2006.

BACKGROUND OF THE INVENTION

1. Field of the Invention

This invention relates to a carrier used to unitize a plurality of containers such as cans or bottles.

2. Description of Prior Art

Container carriers, such as the method and carrier according to this invention, are used to unitize a plurality of containers. Typical containers are bottles, cans and other containers having a sidewall and a chime or raised rib around an upper portion of the container. Much of the prior art in this area, specifically container carriers constructed from polymeric materials, comprises devices that engage the chime or rib around the upper portion of the container. Another style of container carrier is the sidewall-applied carrier wherein the carrier engages the sidewall of the container.

Regardless of the style of container carrier, one challenge in the art is to provide a container carrier that can be used with a variety of containers, including different container diameters and containers having sidewalls with different qualities. Specifically, some containers may include sidewalls that utilize different paints or varnished finishes that may change the coefficient of friction between the container and container engaging portions of the multi-packaging device. Because the container engaging portions of the container carrier are generally elastic, which is governed by the modulus of elasticity or "modulus" of the container carrier, the container carrier relies upon the engagement of a stretched container engaging portion with the container sidewall or chime. Container diameters outside of a narrow range of diameters will either stretch the container engaging portion too much thereby permanently losing elasticity, called "neck-down," or not stretch the container engaging portion at all, both scenarios resulting in package failure.

In addition, container engaging portions may slide too easily or not enough relative to the sidewall of a container depending upon a coefficient of friction of the sidewall thus resulting in package failure. For example, if too much friction occurs between the container engaging portions of the carrier and the container sidewall, application of the carrier will destroy the integrity of the carrier or result in a misapplied carrier relative to the sidewall. Typically, moisture is added to the container or the carrier to permit free sliding of the carrier relative to the container however recent industry trends disfavor use of moisture or water in the packaging process.

Prior art container carriers are typically constructed from a plastic sheet having a single, homogeneous surface having a single coefficient of friction. Prior art container carriers generally require several different versions or configurations to accommodate different container diameters or a certain sidewall smoothness. For example, a matte finish may be applied to an entire carrier to permit application of the carrier to containers having sidewalls with a high coefficient of friction. A disadvantage of the matte finish is that it results in a generally cloudy or opaque carrier that obscures or shrouds graphics on the containers and/or package. It is therefore desirable to provide a container carrier that can accommodate an increased range of containers without adversely affecting package aesthetics.

SUMMARY OF THE INVENTION

A carrier according to one preferred embodiment of this invention is constructed from a generally flexible plastic sheet that is preferably generally transparent and includes a generally smooth surface. According to a preferred embodiment of this invention, a matte finish is incorporated with the plastic sheet.

The matte finish is preferably imparted to the plastic sheet through the use of one or more rollers that are pitted or otherwise treated in one or more sections, rings or bands to provide a desired matte finish in a predetermined width and location along the plastic sheet.

Following application of the matte finish to the plastic sheet 20, portions of the plastic sheet include a smooth surface with a generally transparent appearance and portions include the matte finish that typically includes a generally cloudy appearance. In addition, the matte finish includes a lower coefficient of friction than the smooth surface of the plastic sheet between the plastic sheet and the container.

Thus, according to a preferred method of manufacturing carrier, the plastic sheet with the matte finish arranged in a desired location or locations is formed into individual carriers. According to a preferred embodiment of this invention, each carrier is formed so that the matte finish is longitudinally arranged and positioned between outer bands of the carrier and, more particularly, between outer edges of apertures in the carrier.

This configuration permits the matte finish to slide along container sidewalls during application to containers in the areas between apertures and avoid the tendency of the plastic sheet in that area to engage, drag and/or overstretch relative to the sidewall, particularly a sidewall having a high coefficient of friction or unfavorable surface finish relative to the carrier. Therefore, in a preferred embodiment of the invention, when individual containers are inserted into the carrier to create an assembled package, the containers are positioned within respective container apertures so that the matte finish contacts at least a portion of each container and thus permits the sidewall of the respective container to slide freely enough within container aperture to permit application of carrier to containers without destroying the carrier.

Accordingly, the portion of the carrier that includes the matte finish is preferably positioned along an inner portion of package. The outer bands of the carrier are thus generally transparent and free of the matte finish so as not to block graphics on containers or otherwise disrupt the aesthetics of the package. In addition, the outer bands are engaged with jaws for applying the carrier to the containers thereby permitting free application of the carrier without contact between each container and the outer bands of the carrier until the jaws disengage, at which time container to carrier friction is desired.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

FIGS. 1-4 show a representative method of manufacture, a carrier for carrying an array of containers and a package according to various preferred embodiments of this invention. The physical configuration of carrier 10 and package 50 is merely illustrative and may be varied without departing from the principles of this invention.

In a manner similar to the types of multi-package carriers described above, carrier 10 according to one preferred embodiment of this invention is constructed from a thermoplastic material, preferably an extruded low- to medium-density polyethylene sheet material, or plastic sheet 20 having a generally smooth surface. Plastic sheet 20 is preferably generally transparent. As is common in plastic extrusion, plastic sheet 20 is extruded such that a longitudinal direction of plastic sheet 20 is in a machine direction, by definition the direction of the extrusion that is perpendicular to the face of an extrusion die, and the lateral dimension of plastic sheet 20 is in a transverse direction, the direction of the extrusion that is parallel with the extrusion die.

Figure 1:
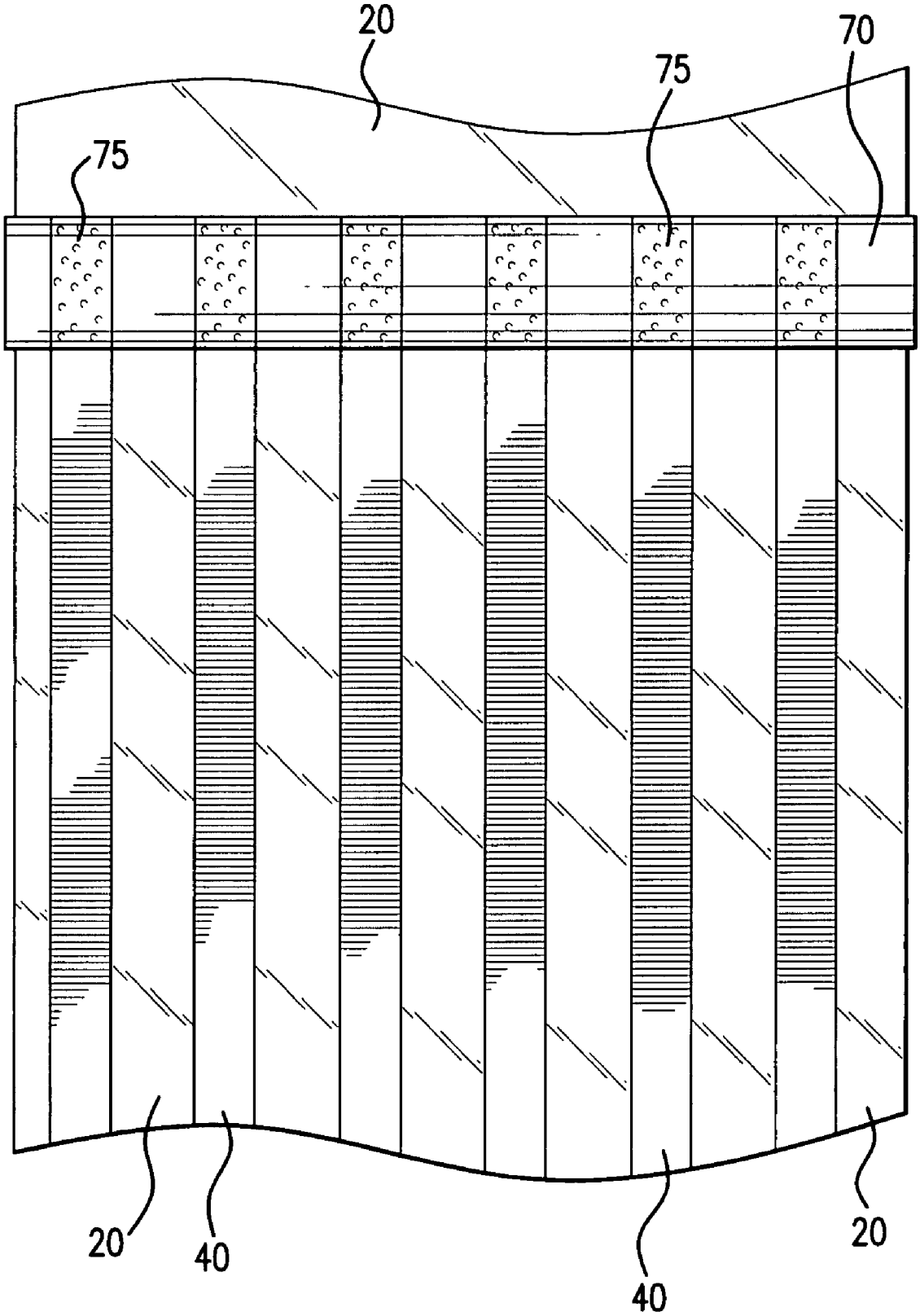
FIG. 1 is a top view of a plastic sheet according to one preferred embodiment of this invention.

According to a preferred embodiment of this invention, matte finish is integrated, along a generally single plane, with plastic sheet 20 in carrier 10 so as to create discrete segments of matte finish 40 integrated with respect to plastic sheet 20. Matte finish 40 is preferably imparted to plastic sheet 20 through the use of roller 70 to create a single, linear thickness of carrier 10, such as shown in FIG. 1.

Roller 70 is preferably a generally smooth, metallic roller, such as an aluminum roller, used post-extrusion to create a generally flat, smooth plastic sheet 20 where desired and a matte finish 40 where desired. Roller 70 may be pitted or otherwise treated in one or more sections 75, rings or bands surrounding roller to result in a desired width and location along plastic sheet 20, as shown in FIG. 1. Plastic sheet 20 may pass over a single roller 70 or between a pair of rollers wherein one or both rollers includes sections 75 with treated or pitted surfaces for imparting matte finish 40 on plastic sheet 20. Sections 75 may be positioned to extend all the way, partially or intermittently around roller 70 so that sections 75 are spaced laterally in one or more predetermined intervals. As a result of the configuration of roller 70 shown in FIG. 1, matte finish 40 is aligned longitudinally along plastic sheet 20 in generally continuous strips.

Following application of matte finish 40 to plastic sheet 20, plastic sheet 20 may include portions having a smooth surface and generally transparent appearance and portions having a matte finish 40 that typically includes a generally cloudy appearance. In addition, matte finish 40 includes a lower coefficient of friction against container 60, specifically relative to a sidewall of container 60, than the smooth surface of the plastic sheet. According to one preferred embodiment of this invention, this lower coefficient of friction relative to container 60 results from a generally pitted surface imparted by roller 70 onto plastic sheet 20 in areas of matte finish 40. Pitted surface, though not visible with the naked eye include microscopic pitting and/or similar surface disruptions that may result in both a cloudy appearance and a lower coefficient of friction relative to container 60 than smooth surfaces of plastic sheet 20.

Thus, according to a preferred method of manufacturing carrier 10 according to this invention, plastic sheet 20 is fed across roller 70 following extrusion of plastic sheet 20. Roller 70 then applies matte finish 40 to a desired portion of plastic sheet 20 and carrier 10 is subsequently formed from plastic sheet 20 so that matte finish 40 is positioned in a desired location.

As such, after matte finish 40 is integrated with, or otherwise applied to, plastic sheet 20, the resulting plastic sheet 20 is preferably stamped or die-cut to create individual carriers 10. As described, plastic sheet 20 is preferably die-cut after the integration of plastic sheet 20 and matte finish 40 for the preferred embodiment of this invention shown in FIGS. 1 and 2 and described above. Plastic sheet 20 is preferably formed using a punch press to die cut and extract material and create the features of carrier 10 described below and generally shown in FIG. 2.

Plastic sheet 20 having integrated matte finish 40 is die-cut to form a plurality of apertures 25, each aperture 25 capable of receiving container 60. A plurality of outer bands 35 are preferably positioned along outer portions of carrier 10 and partially define apertures 25. Outer bands 35 preferably do not include matte finish 40.

Figure 2:
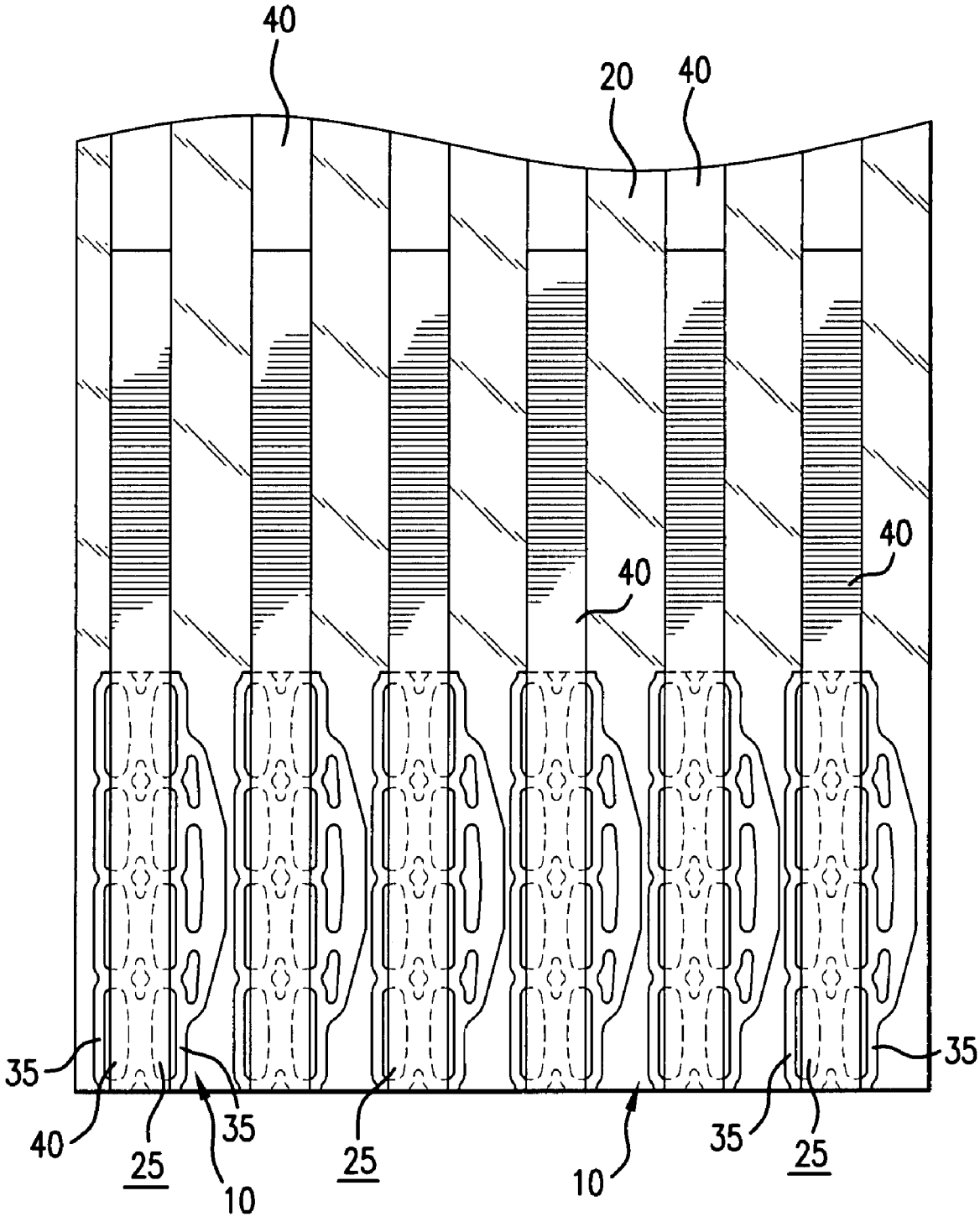
FIG. 2 is a top view of a plastic sheet during formation into carriers according to one preferred embodiment of this invention.
Figure 3:
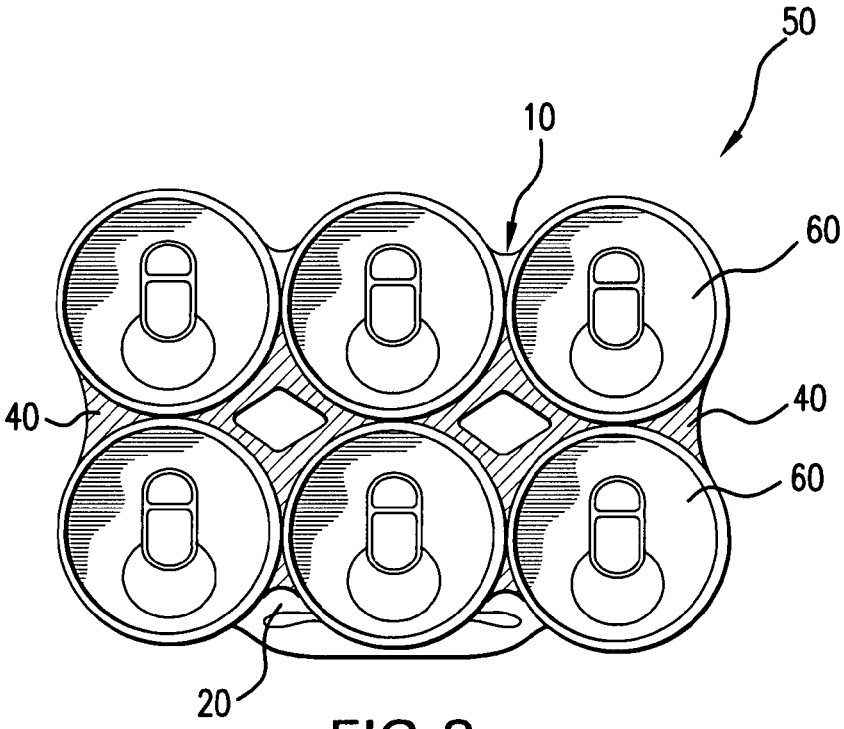
FIG. 3 is a top view of a package according to one preferred embodiment of this invention.

Apertures 25 are preferably arranged in an array of lateral rows and longitudinal ranks. As shown in FIGS. 2, a preferable array is an arrangement of two lateral rows and four longitudinal ranks to form carrier 10 for holding eight containers 60. As shown in FIG. 3, an additional preferable array is an arrangement of two lateral rows and three longitudinal ranks to form carrier 10 for holding six containers 60. Accordingly, rows of apertures 25, although extending lengthwise across plastic sheet 20, are counted laterally across a width of plastic sheet 20 and ranks of apertures 25, although extending widthwise across plastic sheet 20, are counted longitudinally along a length of plastic sheet 20. It should be noted, however, that although FIGS. 2 and 3 show carrier 10 for holding eight and six containers 60, respectively, the invention is not intended to be so limited and carrier 10 may contain any feasible array of apertures 25.

In one preferred embodiment of this invention, shown in FIG. 2, apertures 25 are formed so that matte finish 40 is longitudinally arranged and positioned between outer bands 35 and, more particularly, between outer edges of apertures 25 in the lateral rows of apertures 25. This configuration permits matte finish 40 to slide along container sidewalls in the areas between apertures 25 and avoids the tendency of plastic sheet 20 in that area to drag and overstretch relative to the sidewall of container 60.

Apertures 25 may comprise any suitable opening, preferably, though not necessarily, an elongated opening having an elongation in the longitudinal direction. As shown in FIG. 2, apertures 25 are narrower in the lateral direction than in the longitudinal direction.

When the preceding embodiment of carrier 10 is assembled into a package 50 such as shown in FIG. 3, the plurality of interconnected bands formed by plastic sheet 20 are positioned along the sidewalls of respective containers 60, for instance, approximately 1.5" from a top of each container 60. Package 50 preferably provides a reduced surface finish resistance along the portions of the plastic sheet 20 that include matte finish 40, specifically along a middle portion of plastic sheet 20 extending between outer bands 35 and more specifically between outer edges of apertures 25. A surface finish resistance of container 60 as used in this specification and claims is defined as the amount of resistance a sidewall of container 60 provides as carrier 10 is slid down its surface.

Figure 4:
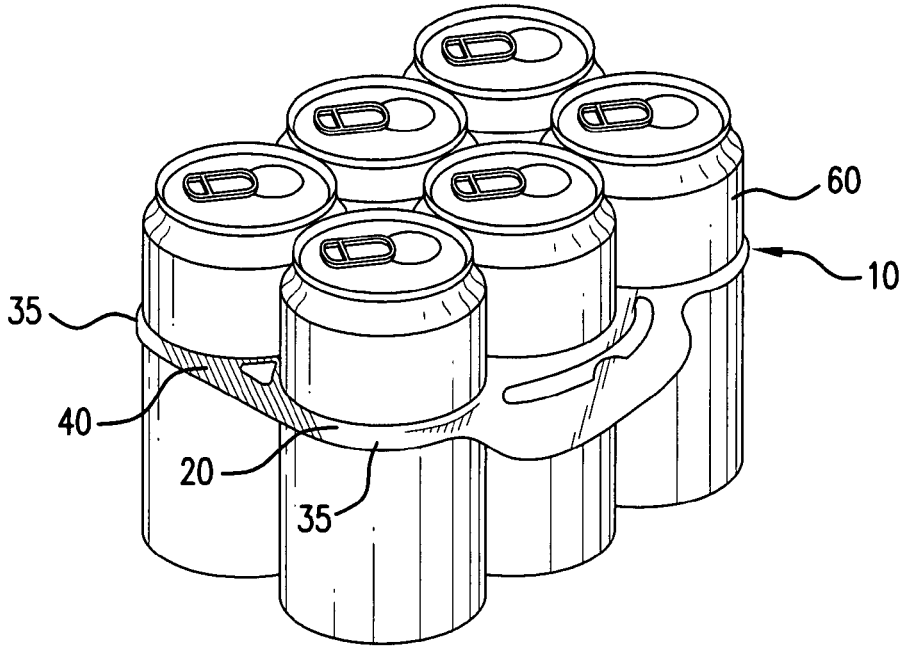
FIG. 4 is a perspective view of a package according to one preferred embodiment of this invention.

In a preferred embodiment of the invention shown in FIGS. 3 and 4, when containers 60 are inserted into carrier 10 to create an assembled package 50, containers 60 are positioned within respective container apertures 25 so that matte finish 40 contacts at least a portion of each container 60. This arrangement permits the sidewall of container 60 to slide freely enough within container aperture 25 to permit application of carrier 10 to containers 60 without destroying carrier 10.

Accordingly, the portion of plastic sheet 20 that includes matte finish 40 is preferably positioned along an inner portion of package 50. Outer bands 35 of carrier 10 are thus generally transparent and free of matte finish 40 so as not to block graphics on containers 60 or otherwise disrupt the aesthetics of package 50.

Carrier 10 will therefore unitize groups of containers having a range of diameters and a range of sidewall characteristics, including container sidewalls having high coefficients of friction. Carrier 10 according to this invention will permit a single carrier 10 to engage a relatively broad range of existing and conceivable containers.

In addition, according to another preferred embodiment of this invention, carrier 10 is engaged and applied to containers 60 by sets of moveable jaws (not shown). These moveable jaws typically engage carrier 10 along outer bands 35 and then stretch carrier 10 for application onto containers 60. As a result of the described embodiment, portions of carrier 10 that include matte finish 40 maintain exclusive contact with the sidewalls, and are slideable relative to the sidewalls, of the respective containers 60 until carrier 10 is applied to containers 60 and jaws are released from outer bands 35. Outer bands 35 are then released into engagement with containers 60 thereby providing a higher coefficient of friction relative to the sidewalls than matte finish 40 of carrier 10. This results in a package having containers 60 tightly and firmly maintained within carrier 10.

While in the foregoing specification this invention has been described in relation to certain preferred embodiments thereof, and many details have been set forth for purposes of illustration, it will be apparent to those skilled in the art that the apparatus is susceptible to additional embodiments and that certain of the details described herein can be varied considerably without departing from the basic principles of the invention.

The invention claimed is:

1. A method for manufacturing a container carrier having an array of apertures each for receiving a container, the method comprising:

feeding a flexible plastic sheet having a generally smooth finish across a roller;

applying a matte finish to a surface of the plastic sheet with the roller in a matte finish longitudinal strip alternating with a smooth finish longitudinal strip;

forming the container carrier into the plastic sheet so that the matte finish is positioned between outer bands of the plurality of container apertures wherein the outer bands retain the smooth finish; and applying the container carrier to a plurality of containers to form a package, each container of the plurality of containers positioned within a respective aperture so that the matte finish contacts an inner portion of each container along an inner portion of the package and the smooth finish contacts an outer portion of each container facing out from the package.

2. The method of claim 1 wherein the matte finish has a different coefficient of friction relative to a sidewall of the container than the smooth finish.

3. The method of claim 1 wherein the roller comprises a metallic roller having a generally smooth surface and at least one pitted section extending around the roller.

4. The method of claim 3 wherein the roller comprises a plurality of pitted sections extending around the roller in predetermined intervals.

5. The method of claim 1 further comprising the step:

feeding the sheet through a roller having a plurality of pitted sections extending around the roller.

6. The method of claim 1 wherein the smooth finish is generally transparent so as to not block graphics on the containers.

* * * * *